US006929562B2

(12) United States Patent
Kumamoto

(10) Patent No.: US 6,929,562 B2
(45) Date of Patent: Aug. 16, 2005

(54) GOLF CLUB SHAFT AND IRON GOLF CLUB SET

(75) Inventor: Tomio Kumamoto, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/255,648

(22) Filed: Sep. 27, 2002

(65) Prior Publication Data

US 2003/0083143 A1 May 1, 2003

(30) Foreign Application Priority Data

Sep. 28, 2001 (JP) ..... 2001-304558

(51) Int. Cl.[7] ..... A63B 53/10
(52) U.S. Cl. ..... 473/319; 473/316
(58) Field of Search ..... 473/316–323, 473/289

(56) References Cited

U.S. PATENT DOCUMENTS 1,974,271 A * 9/1934 Hackett ..... 473/316
4,563,007 A * 1/1986 Bayliss et al. ..... 473/409
5,924,936 A * 7/1999 Penley ..... 473/289
6,056,648 A * 5/2000 Kusumoto et al. ..... 473/319
6,110,056 A * 8/2000 Yamamoto ..... 473/289

FOREIGN PATENT DOCUMENTS

JP 11-216206 * 8/1999
JP 2000-126338 A 5/2000

* cited by examiner

*Primary Examiner*—Stephen Blau
(74) *Attorney, Agent, or Firm*—Birch, Stewart, Kolasch & Birch, LLP

(57) ABSTRACT

A golf club shaft (1) in which a difference between a maximum EI value and a maximum EI value in the range from a tip (1*a*) to a position spaced therefrom at a distance corresponding to not less than 40% nor more than 60% of the whole length of the shaft (1) is set to less than 10% of the average of the maximum EI value and the minimum EI value in the range. The diameter of the tip (1*a*) of the shaft (1) is set to not less than 9.0 mm nor more than 12.0 mm. The shaft (1) is applied to an iron club set consisting of a plurality of iron golf clubs having different numbers.

13 Claims, 5 Drawing Sheets

GOLF CLUB SHAFT AND IRON GOLF CLUB SET

BACKGROUND OF THE INVENTION

This non-provisional application claims priority under 35 U.S.C. § 119(a) on Patent Application No. 2001-304558 filed in Japan on Sep. 28, 2001, which is herein incorporated by reference.

1. Field to the Invention

The present invention relates to a golf club shaft and an iron golf club set and more particularly to a golf club at and an iron golf club set capable of hitting a golf ball a long distance with an improved controlling performance.

2. Description of the Related Art

In recent years, a golf club shaft using a carbon fiber having a high specific strength and specific rigidity is manufactured and commercially available. As the specific strength of the carbon fiber and the specific rigidity thereof have become higher, lightweight golf club shafts can be manufactured.

The use of the carbon fiber having a high specific strength and specific rigidity widens the degree of from in designing the golf club shaft. Thus for example, in recent years, it is possible to design the shaft in such a way as to partially vary the rigidity value thereof. The iron golf club is particularly required to hit a golf ball a long distance with a high degree of control. Thus there have been various attempts made to differentiate the distribution of rigidity in a region of the shaft from that of other regions thereof.

In the iron golf clubs disclosed in Japanese Patent Application Laid-Open No. 2000-126338, the flexural rigidity of a specified position of a higher-numbered golf club (short iron) spaced from the butt thereof is set to be lower than a specified position of a lower-numbered golf club (long iron) spaced from the butt thereof.

However, in the iron golf club set disclosed in Japanese Patent Application Laid Open No. 2000-126338, the rigidity of the shaft at its tip side is not taken into consideration. Thus the golf club does not allow a player to precisely control the flight distance of a golf ball and the like, although it allows the player to hit the golf ball a long distance. The shafts of golf clubs having higher numbers, namely, the short irons, are required to provide an accurate controlling performance. In addition, the shafts are required to have a sufficient flexibility to hit the golf ball high and stop it at a desired position on the green. However, the shaft of the iron golf club disclosed in Japanese Patent Application Laid-Open No. 2000-126338 is incapable of realizing these requirements. Particularly, an iron golf club set is required to provide a reliable performance without being adversely affected by the differences in the lengths of the golf club shafts.

Other proposals have been made to provide a golf club shaft that allows a player to hit a golf ball a long distance and precisely control the flight distance, and the like. As the golf club shaft becomes lightweight, the head speed of the golf club increases and thus a player can hit the golf ball a longer distance compared with conventional clubs. However, the lightweight golf club does not allow incompetent players and aged persons to securely hit the golf ball a sufficiently long distance. Even though a player can hit the golf ball to a target point therewith, the player's performance in controlling the flight distance and the like, deteriorates. Thus the lightweight golf club does not allow a player to precisely control the flight distance and the like, although it allows the player to hit a golf ball a long distance.

SUMMARY OF THE INVENTION

The present invention has been made in view of the above-described problems. Therefore it is an object of the present invention to provide a golf club shaft that allows a player to hit a golf ball a long distance while precisely controlling the fight distance, and the like. It is another object of the present invention to provide an in golf club set, having a plurality of iron golf clubs, which realizes a reliable performance without creating problems to a player, irrespective of the particular length of the iron golf club, i.e., long irons or short irons.

To achieve this object, according to the present invention, there is provided a golf club shaft in which a difference between a maximum EI value and a minimum EI value in a range from the tip of the golf club to a position spaced a distance therefrom corresponding to not less than 40% nor more than 60% of a whole length of the shaft is set to be less than 10% of the average of the maximum EI value and the minimum EI value in the range. The diameter of the tip of the shaft is set to be not less than 9.0 mm nor more than 12.0 mm.

As described above, the EI (flexural rigidity) value is almost constant, i.e., the EI value does not vary in the range from the tip of the shaft to its center in its longitudinal direction. Further the diameter of the shaft at its tip is specified. Therefore the entire part of the shaft at its tip side is allowed to be flexible. In addition the shaft is allowed to be entirely flexible and capable of hitting a golf ball a long distance. Further the EI value is almost constant at the tip side of the shaft, and the diameter of the tip of the shaft is specified. Thus the shaft is stable when it is swung and exhibits an advantageous control performance.

As described above, the EI value is specified in the range from the tip of the shaft to a position spaced therefrom at the distance corresponding to not less than 40% nor more than 60% of the whole length of the shaft and advantageously not less than 45% nor more than 55% of the whole length thereof. This is for the reason described below. If the EI value is specified in the range from the tip of the shaft to the position spaced therefrom at a distance corresponding to less than 40% of the whole length of the shaft, the shaft has a smaller flexible portion in the range from its tip to its central portion. Consequently the effect of the present invention of hitting a golf ball a long distance cannot be achieved. On the other hand, if the EI value is specified in the range from the tip of the shaft to a position spaced therefrom at a distance corresponding to more than 60% of the shaft, the shaft has an excessively large flexible portion. Consequently the shaft exhibits a deterioration in control performance.

The difference between the maximum EI value and the minimum EI value is set to less than 10% and advantageously less than 6% of the average of the maximum EI value and the minimum EI value in the above-described range. More specifically, the variation of the EI value in the above-described range is set to less than ±5% and favorably less than ±3%. If the difference between the maximum EI value and the minimum EI value in the specified range is more than 10% of the average of the maximum EI value and the minimum EI value, it is impossible to obtain the effect of the present invention of allowing a player to hit a golf ball a long distance which precisely controlling the flight distance of the golf ball, and the like.

The diameter (outer diameter) of the tip of the shaft is set to be not less than 9.0 mm or more than 12.0 mm, preferably not less than 9.1 mm or more than 11.0 mm, and more favorably not less than 9.2 mm or more than 10.5 mm. If the diameter of the tip of the shaft is less than 9.0 mm, the shaft is liable to become broken at its neck, with a deterioration in the level of control. On the other hand, if the diameter of the tip of the shaft is more than 12.0 mm, the rigidity value of the shaft at its tip side becomes too high, which makes it difficult to design the shaft in such a way to render it flexible.

The maximum EI value in the range from the tip of the shaft to a position spaced therefrom at a distance corresponding to not less than 40% or more than 60% of the whole length of the shaft is set to not less than 1.0 $kg \cdot m^2$ or more than 3.5 $kg \cdot m^2$ and favorably not less than 1.2 $kg \cdot m^2$ nor more than 2.5 $kg \cdot m^2$. If the maximum EI value is less than 1.0 $kg \cdot m^2$, the entire shaft is so soft that its stability deteriorates. Therefore a player is apt to feel that the shaft is unreliable. On the other hand, if the maximum EI value is more than 3.5 $kg \cdot m^2$, the entire shaft becomes so hard that it is difficult for the shaft to deform and hit the golf ball a long distance.

It is preferable that the minimum EI value in a range from the butt of the shaft to a position spaced therefrom at a distance corresponding to 30% of the whole length of the shaft is set to 1.7–3.5 times larger than the maximum EI value in the range from the tip of the shaft to the position spaced therefrom at the distance corresponding to not less than 40% nor more than 60% of the whole length of the shaft. As described above, the EI value in the range from the tip of the shaft to the vicinity of the center of the shaft is set to be almost the same value to allow the shaft to be entirely flexible. Further, as described above, the ratio between the minimum EI value and the maximum EI value is set in such a way that the minimum EI value in the specified range at the butt side is larger than the maximum EI value in the specified range at the tip side to thereby increase the flight distance and control performance of the golf ball.

That is, it is preferable that the minimum EI value in the above-described range from the butt of the shaft is set to 1.7–3.5 times larger than the maximum EI value in the above-described range from the tip of the shaft.

If the ratio is less than 1.7 times, the shaft is not flexible like a whip. A power less occurs at the time of an impact of the shaft on a golf ball. Thus a flight distance decreases. On the other hand, if the ratio is more than 3.5 times, a larger shock is applied to a player's hand, which gives the player an unfavorable feeling when hitting the golf ball.

The reason the minimum EI value in the range from the butt of the shaft to the position spaced therefrom at the distance corresponding to 30% of the whole length of the shaft is set to the comparison range of the EI value is because the above-described range from the butt of the shaft contributes greatly to the increase of the controlling performance and feeling of stiffness and contributes greatly to the increase of the flight distance of the golf ball owing to the flexibility of the tip side of the shaft.

More specifically, supposing that a long iron consists of #2 (No. 2 iron), #3 (No. 3 iron), and #4 (No. 4 iron), that a middle iron consists of #5 (No. 5 iron), #6 (No. 6 iron), and #7 (No. 7 iron), that a short iron consists of #8 (No. 8 iron), #9 No. 9 iron), a PW (pitching wedge), an AW (approach wedge), and a SW (sand wedge), it is preferable to set the ratio of the minimum EI value in the range from the butt of the shaft to the maximum EI value in the range from the tip of the shaft as follows for each of the short iron, the middle iron, and the long iron.

In the short iron, the ratio is 1.7–2.3 times, favorably 1.75–2.10 times, and more favorably 1.8–2.0 times. In the middle iron, the ratio is 2.0–2.7 times, favorably 2.2–2.5 times, and more favorably 2.3–2.4 times. In the long iron, the ratio is 2.5–3.5 times, favorably 2.7–3.4 times, and more favorably 2.9–3.2 times.

The lower (long iron) the number of the iron is, the longer the whole length thereof is. Therefore the higher the ratio of the minimum EI value in the above-described range from the butt of the shaft to the maximum EI value in the above-described range from the tip of the shaft is, the higher the curvature of the shaft at a flexed point is and the larger the flexure at the tip side of the shaft is. Thus the iron composed of the shaft is capable of hitting a golf ball a long distance.

It is preferable that the center of gravity of the shaft is situated in the range from the tip of the shaft to the position spaced therefrom at the distance corresponding to not less than 40% nor more than 60% of the whole length of the shaft. Thereby the shaft can be swung easily and its operability can be improved. It is preferable that the inclination rate of the outer diameter of the shaft in an intermediate portion between the range from the tip of the shaft to the position spaced therefrom at the distance corresponding to not less than 40% nor more than 60% of the whole length of the shaft and the range from the butt of the shaft to the position spaced therefrom at the distance corresponding to 300% of the whole length of the shaft is set to not less than $^{10}/_{1000}$ nor more than $^{20}/_{1000}$.

By specifying the inclination rate in this way, the EI value at the tip side of the shaft and that at the butt side thereof in this manner can be set favorably. Thus it is possible for the player to obtain a favorable feeling in hitting the golf ball.

If the inclination rate is out of the above-described range, it is impossible for the tip side of the shaft to sufficiently display the flexing function and for the butt side thereof to sufficiently display the controlling function and give a feeling of stiffness to a player. More specifically, if the inclination rate is smaller than $^{10}/_{1000}$, it is difficult to set the ratio between the EI value in the range from the tip of the shaft to the position spaced therefrom at the distance corresponding to not less than 40% nor more than 60% of the whole length of the shaft and the EI value in the range from the butt of the shaft to the position spaced therefrom at the distance corresponding to 30% of the whole length of the shaft. If the inclination rate is smaller than $^{10}/_{1000}$, the user has a bad feeling in hitting the golf ball. On the other hand, if the inclination rate is larger than $^{20}/_{1000}$, it is difficult to easily accomplish polished finish, buff is liable to remain, it is difficult to paint the shaft, and it is difficult to apply a transfer mark to the shaft in the manufacturing process.

The golf club shaft of the present invention is applicable to all kinds of golf clubs including a wood, an iron, a putter, and the like. However, it is most favorable to apply the golf club shaft of the present invention to the iron.

It is preferable that the golf club shaft is made of a fiber reinforced resin which is lightweight and has a high strength. However, the golf club shaft may be made of metal such as stainless steel. As resins of the fiber reinforced resin, thermosetting resin and thermoplastic resin can be used singly or in combination. In consideration of strength and rigidity, the thermosetting resin can be preferably used. Above all, epoxy resin is particularly preferable. High-performance fibers such as carbon fiber, glass fiber, and metal fiber can be used as reinforcing fibers. Of these fibers, the carbon fiber is most favorable because it is lightweight and has a high strength. These reinforcing fibers are used as long and short fibers. The configuration and arrangement of the reinforcing fibers are not limited. Two or more of these reinforcing fibers can be used in combination.

In the case where the golf club shaft is made of the fiber reinforced resin, the weight of the shaft is set to not less than 50 g nor more than 80 g and preferably not less than 55 g nor more than 70 g. Thereby it is possible to obtain a golf club shaft that is lightweight, has a high strength, and a high operability.

The present invention provides an iron golf club set consisting of a plurality of iron golf clubs having different numbers. The iron golf clubs are composed of golf club shafts of the present invention.

By composing the irons of the golf club shafts of the present invention and providing the iron golf club set consisting of the irons, a player can hit a golf ball a long distance and precisely control a flight distance and the like without discomfort being given to the player irrespective of the difference in the lengths of shafts of various numbers.

The normal iron golf club set consists of No. 3 iron through No. 9 iron. In addition, the iron golf club set of the present invention includes a driving iron (No. 2 iron), a No. 10 iron, and wedges such as a sand wedge. The iron golf club set of the present invention also includes a so-called half set consisting of odd-numbered iron clubs. The iron golf club set of the present invention also includes two or more irons of selected numbers.

The iron golf club set of the present invention should include at least two irons each composed of the golf club shaft of the present invention. It is favorable that each of the long iron, the middle iron, and the short iron includes at least one iron composed of the golf club shaft of the present invention. It is favorable to apply the golf club shaft of the present invention to the No. 2 iron and the No. 3 iron. It is optimum to apply the golf club shaft of the present invention to all golf clubs of the golf club set.

In the iron golf club set of the present invention, it is preferable that the center of gravity of each of the golf club shafts is disposed closer toward a butt thereof and a GI (twist rigidity) value of each of the golf club shaft in a range of 15 cm from the butt thereof is set larger in the iron golf clubs having higher numbers than in the iron golf clubs having lower numbers.

In the short irons having higher numbers, the controlling performance and operability thereof are particularly important. By disposing the center of gravity of the shaft closer to the butt side in the short irons having higher numbers than in the short irons having lower numbers, they have high controlling performance and operability. The player holds the grip of the shaft in the range of about 15 cm from the butt of the shaft. By making the GI value in the range of 15 cm from the butt of the shaft large in the short irons having higher numbers, the player can hold the grip easily and hence operate the shaft with a high operability.

It is preferable that the GI value in the range of 15 cm from the butt of the shaft is not less than 4.0 $kg \cdot m^2$ nor more than 6.0 $kg \cdot m^2$ in the short iron, not less than 3.5 $kg \cdot m^2$ nor more than 5.5 $kg \cdot m^2$ in the middle iron, and not less than 2.1 $kg \cdot m^2$ nor more than 3.5 $kg \cdot m^2$ in the long iron. If the GI value of each of the short iron, the middle iron, and the long iron is smaller than the above set value, a twist at the butt side is large and the controlling performance is liable to deteriorate. On the other hand, if the GI value of each of the short iron, the middle iron, and the long iron is larger than the above set value, a shock to be transmitted to the player's hand is large (player feels hard). Thus the player has a bad feeling in hitting the golf ball.

It is preferable that the center of gravity of the shaft is positioned at not less than 495 mm nor more than 510 mm from the end of the tip of the shaft in the short iron, at not less than 485 mm nor more than 500 mm from the end of the tip of the shaft in the middle iron, and at not less than 480 mm nor more than 500 mm from the end of the tip of the shaft in the long iron. To adjust the position of the center of gravity of the shaft, it is preferable to mount a glass sheet or a tungsten sheet on the butt side of the shaft. Thereby it is possible to adjust the position of the center of gravity of the shaft without affecting the performances of the shaft such as rigidity.

It is preferable that the length of the shaft is not less than 800 nor more than 920 mm in the short iron, not less than 910 mm nor more than 960 mm in the middle iron, and not less than 950 mm nor more than 1000 mm in the long iron. By setting the length of the shaft to the above range for each of the short iron, the middle iron, and the long iron, the shaft allows the player to hit a golf ball a long distance and precisely control a flight distance thereof and the like.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from his detailed description.

BRIEF DESCRIPTION OF THE DRAWINGS

The present invention will become more fully understood from the detailed description given hereinbelow and the accompanying drawings which are given by way of illustration only, and thus are not limitative of the preset invention, and wherein.

DETAILED DESCRIPTION OF THE PREFERRED EMBODIMENTS

Figure 1:
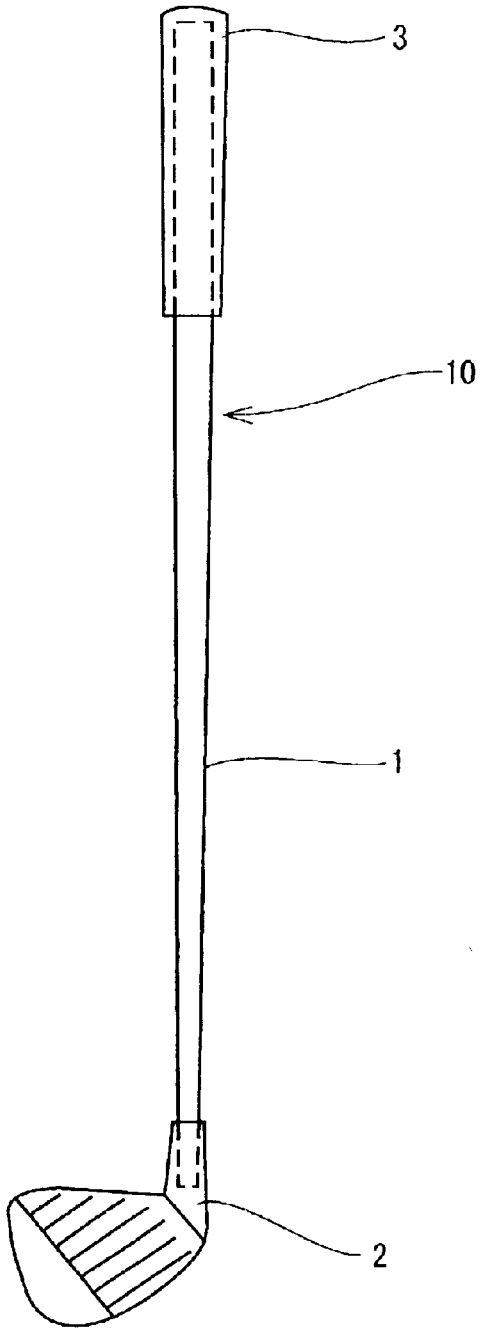
FIG. 1 is a schematic view showing an iron golf club according to a first embodiment of the present invention.
Figure 2:
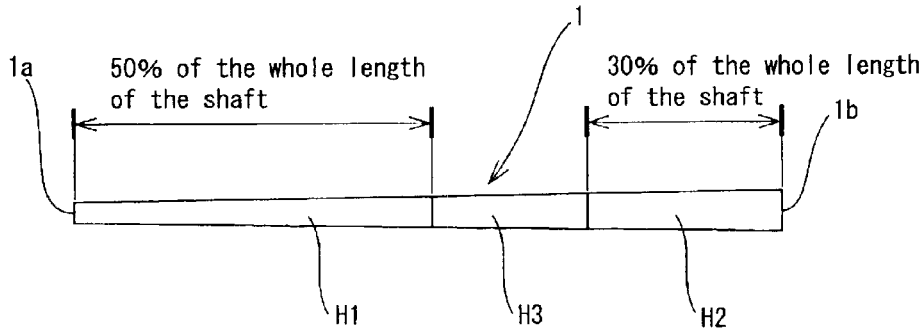
FIG. 2 shows a golf club shaft used in an iron golf club according to the first embodiment of the present invention.

The embodiments of the present invention will be described below with reference to drawings. FIGS. 1 and 2 show a first embodiment of an iron golf club 10 that is used as a long iron constructed of the golf club shaft of the present invention. A shaft 1 is tapered and composed of a laminate of prepregs layered one upon another. An iron head 2 is installed on the shaft 1 at one end of a smaller diameter side thereof. A grip 3 is installed on the shaft 1 at the other end of a larger diameter side thereof.

The iron golf club 10 that is used as the long iron is a No. 4 iron club. The shaft 1 has a length of 960 mm. The diameter of the shaft 1 at its tip is 10.0 mm. The center of gravity of the shaft 1 is positioned at 496 mm apart from the tip of the shaft 1.

The difference between a maximum EI value and a minimum EI value in a range H1 of the shaft 1 from the tip 1*a* to a position spaced therefrom at a distance corresponding to 50% of the whole length of the shaft 1 is set constant at 5% of the average of the maximum EI value and the minimum EI value in the range H1. The maximum EI value in the range H1 from the tip 1*a* of the shaft 1 to the position spaced therefrom at the distance corresponding to 50% of the whole length of the shaft 1 is set to 2.5 kg·m$^2$.

A minimum EI value in a range H2 from a butt 1*b* of the shaft 1 to a position spaced therefrom at a distance corresponding to 30% of the whole length of the shaft 1 is set to three times larger than the maximum EI value in the range H1 from the tip 1*a* of the shaft 1 to the position spaced therefrom at the distance corresponding to 50% of the whole length of the shaft 1. A GI (twist rigidity) value in the range from the butt 1*b* of the shaft 1 to a position spaced therefrom at a distance of 15 cm is set to 3.0 kg·m$^2$.

The inclination rate of the outer diameter of the shaft 1 in an intermediate portion H3 in the longitudinal direction of the shaft 1 between the range H1 and the range H2 is set to $^{15}/_{1000}$. As described above, the range H1 is from the tip 1*a* of the shaft 1 to the position spaced therefrom at the distance corresponding to 50% of the whole length of the shaft 1. The range H2 is from the butt 1*b* of the shaft 1 to the position spaced therefrom at the distance corresponding to 30% of the whole length of the shaft 1.

Prepregs of the shaft 1 are layered one upon another by winding them around a core metal (mandrel) in the order from the inner peripheral side thereof to the peripheral side thereof. Carbon fibers are used as a reinforcing fiber of the prepregs. An epoxy resin is used as a matrix resin thereof.

The shaft 1 is formed by sheet winding method as follows: After the prepregs are layered one upon another by sequentially winding them on the core metal (not shown), a tape made of polyethylene terephthalate is lapped on a laminate thereof. Then the tape-lapped laminate is heated in an oven under a pressure to harden the resin. Thereby the prepregs are integrated with each other. Thereafter the core metal is drawn from the integrated prepregs.

As described above, the EI (flexural rigidity) value is almost constant, that is, does not have variations in the range from the tip 1*a* of the shaft 1 to approximately the center in its longitudinal direction. Therefore not only the shaft 1 at its tip side but also the shaft 1 is allowed to be entirely flexible. Thus a player can hit the golf ball a long distance with the shaft 1. Further since the EI value is almost constant at the tip side of the shaft 1, the shaft 1 is stable when it is swung and thus exhibits an advantageous control feature.

Figure 3A:
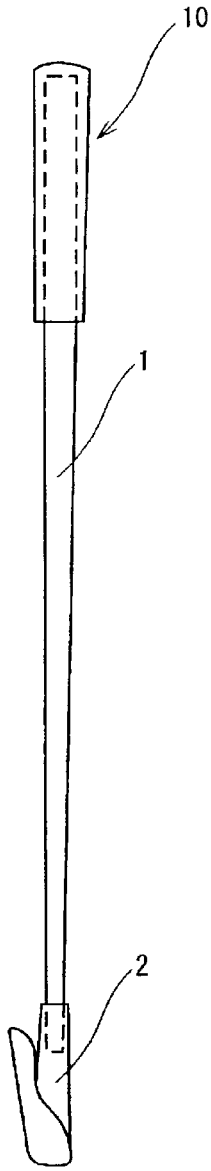
FIGS. 3A, 3B, and 3C are schematic views showing an iron golf club that is used as a long iron, a middle iron, and a short iron respective.

As shown in FIG. 3A, the iron golf club 10 of the first embodiment is used as a long iron. However, the iron golf club 10 can be used as a middle iron, a short iron, and the like by altering the length of the shaft of the present invention, the kind of iron head to be mounted thereon, the rigidity distribution of the shaft, and the like.

Figure 3B:
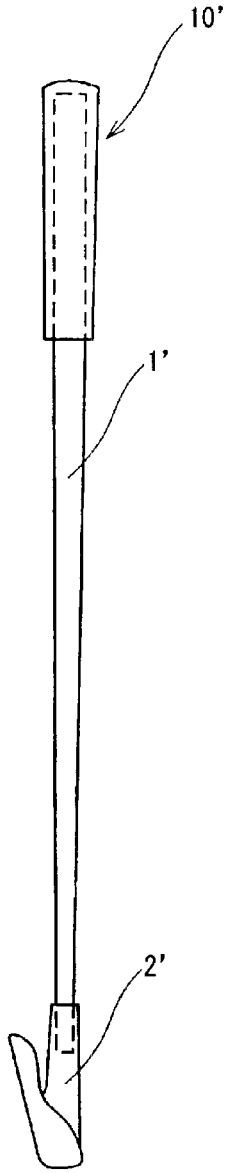

More specifically, a No. 5 iron head 2' is mounted on an iron golf club 10' that is used as the middle iron, as shown in FIG. 3B. A shaft 1' has a length of 945 mm, a diameter of 10.0 mm at its tip, and the center of gravity at a position spaced at 499 mm from the tip thereof.

The minimum EI value in the range from the butt of the shaft 1' to a position spaced therefrom at a distance corresponding to 30% of the whole length of the shaft 1' is set to 2.2 times larger than the maximum EI value in the range from the tip of the shaft 1' to a position spaced therefrom at a distance corresponding to 50% of the whole length of the shaft 1'. The GI value in the range from the butt of the shaft 1' to a position spaced therefrom at a distance of 15 cm is set to 5.0 kg·m$^2$. The EI value and the inclination rate in the range from the tip of the shaft 1' to the position spaced therefrom at the distance corresponding to 500% of the whole length of the shaft 1' are set to the same values as those of the first embodiment.

Figure 3C:
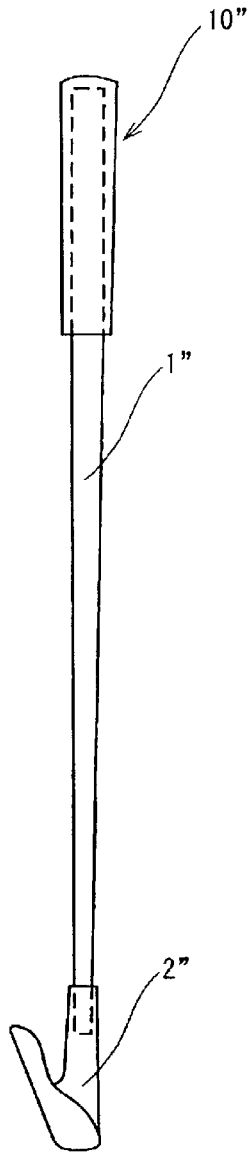

A No. 9 iron head 2' is mounted on an iron golf club 10 that is used as the short iron, as shown in FIG. 3C. A shaft 1" has a length of 895 mm, a diameter of 10.0 mm at its tip, and the center of gravity at a position spaced at 502 mm from the tip thereof.

The minimum EI value in the range from the butt of the shaft 1' to a position spaced therefrom at a distance corresponding to 30% of the whole length of the shaft 1' is set to 1.9 times larger than the maximum EI value in the range from the tip of the shaft 1" to a position spaced therefrom at a distance corresponding to 50% of the whole length of the shaft 1". The GI value in the range from the butt of the shaft 1" to a position spaced at a distance of 15 cm therefrom is set to 5.0 kg·m$^2$. The EI value and the inclination rate in the range from the tip of the shaft 1" to the position spaced therefrom at the distance corresponding to 50% of the whole length of the shaft 1" are set to the same values as those of the first embodiment.

An iron golf club set of the present invention consists of one (No. 3) long iron composed of the iron golf club 10 or the golf club shaft of the present invention, two middle irons (No. 6 and No. 7) composed of the iron golf club 10' or the golf dub shaft of the present invention, and four short irons (No. 8, PW, AW, SW) composed of the iron golf club 10" or the golf club shaft of the present invention.

It is possible to easily obtain a golf club shaft excellent in the performance of hitting a golf ball a long distance and in the controlling its performance by specifying the EI value and the diameter of the shaft at its tip. Thus the golf club shaft of the present invention is applicable to iron golf clubs of various numbers. Therefore using the iron golf dub set having such iron golf clubs, it is possible to hit the golf ball a long distance and realize a reliable controlling performance without being affected by the difference in the lengths of the shafts of the various clubs in the set. That is, a player can use all the irons in a very effective manner.

Examples 1 through 18 of iron golf clubs containing the golf club shafts of the present invention and comparison examples 1 through 6 will be described below.

The EI value, the GI value, the diameter of the tip, the inclination rate, the position of the center of gravity, and the length of each shaft were set, as shown in tables 1 through 3. The shafts were prepared using prepregs having the construction which will be described below.

TABLE 1

| | CE1 | CE2 | E1 | E2 | E3 | E4 | E5 | E6 |
|---|---|---|---|---|---|---|---|---|
| Ratio of minimum EI value in range from butt to 30% of whole length of shaft to maximum EI value in range from tip to 40%–60% of whole length of shaft | 1.5 | 2.8 | 3.0 | 3.2 | 3.0 | 3.0 | 2.9 | 3.2 |
| Diameter (mm) of tip | 9.5 | 8.5 | 10.0 | 11.0 | 10.0 | 10.0 | 10.0 | 10.0 |
| GI value (kg · m$^2$) in range of 15 cm from butt | 2.0 | 3.0 | 3.0 | 3.0 | 3.0 | 3.0 | 3.0 | 3.0 |

TABLE 1-continued

| | CE1 | CE2 | E1 | E2 | E3 | E4 | E5 | E6 |
|---|---|---|---|---|---|---|---|---|
| Inclination rate of outer diameter at center of shaft | 8/1000 | 15/1000 | 15/1000 | 12/1000 | 15/1000 | 15/1000 | 15/1000 | 15/1000 |
| EI value-variation-specified range from tip (percentage to whole length of shaft) | 30% | 40% | 50% | 50% | 45% | 55% | 50% | 50% |
| Maximum EI value (kg · $m^2$) in EI value-variation-specified range from tip | 3.00 | 5.00 | 2.50 | 3.00 | 2.50 | 2.50 | 2.50 | 2.50 |
| Position of center of gravity of shaft (from tip) (mm) | 495 | 498 | 496 | 497 | 497 | 497 | 497 | 497 |
| Variation of EI value (%) | 12 | 10 | 5 | 5 | 5 | 5 | 5 | 8 |
| Length of shaft (mm) | 945 | 945 | 960 | 960 | 960 | 960 | 960 | 972 |
| Number | 4 | 4 | 4 | 4 | 4 | 4 | 4 | 3 |
| Flight distance | X | X | ○ | ○ | ○ | ○ | ○ | ○ |
| Controlling performance | X | Δ | ◎ | ○ | ◎ | ◎ | ◎ | ◎ |

where "CE" denotes comparison example.
where "E" denotes example.

TABLE 2

| | CE3 | CE4 | E7 | E8 | E9 | E10 | E11 | E12 |
|---|---|---|---|---|---|---|---|---|
| Ratio of minimum EI value in range from butt to 30% of whole length of shaft to maximum EI value in range from tip to 40%–60% of whole length of shaft | 1.8 | 3.2 | 2.2 | 2.5 | 2.2 | 2.2 | 2.3 | 2.4 |
| Diameter (mm) of tip | 9.5 | 8.5 | 10.0 | 11.0 | 10.0 | 10.0 | 10.0 | 10.0 |
| GI value (kg · $m^2$) in range of 15 cm from butt | 2.5 | 4.5 | 5.0 | 5.0 | 5.0 | 5.0 | 5.0 | 5.0 |
| Inclination rate of outer diameter at center of shaft | 8/1000 | 15/1000 | 15/1000 | 12/1000 | 15/1000 | 15/1000 | 15/1000 | 15/1000 |
| EI value-variation-specified range from tip (percentage to whole length of shaft) | 30% | 40% | 50% | 50% | 45% | 55% | 50% | 50% |
| Maximum EI value (kg · $m^2$) in EI value-variation-specified range from tip | 3.00 | 5.00 | 2.50 | 3.00 | 2.50 | 2.50 | 2.50 | 2.50 |
| Position of center of gravity of shaft (from tip) (mm) | 498 | 501 | 499 | 500 | 500 | 500 | 500 | 500 |
| Variation of EI value (%) | 12 | 10 | 5 | 5 | 5 | 5 | 5 | 5 |
| Length of shaft (mm) | 905 | 905 | 945 | 945 | 945 | 945 | 945 | 933 |
| Number | 5 | 5 | 5 | 5 | 5 | 5 | 5 | 6 |
| Flight distance | X | X | ○ | ○ | ○ | ○ | ○ | ○ |
| Controlling performance | X | Δ | ○ | ○ | ○ | ○ | ◎ | ◎ |

where "CE" denotes comparison example.
where "E" denotes example.

TABLE 3

| | CE5 | CE6 | E13 | E14 | E15 | E16 | E17 | E18 |
|---|---|---|---|---|---|---|---|---|
| Ratio of minimum EI value in range from butt to 30% of whole length of shaft to maximum EI value in range from tip to 40%–60% of whole length of shaft | 1.5 | 2.5 | 1.9 | 2.1 | 2.0 | 2.0 | 1.8 | 2.0 |
| Diameter (mm) of tip | 9.5 | 8.5 | 10.0 | 11.0 | 10.0 | 10.0 | 10.0 | 10.0 |
| GI value (kg · $m^2$) in range of 15 cm from butt | 4.0 | 3.0 | 4.0 | 3.0 | 4.0 | 4.0 | 4.0 | 4.0 |
| Inclination rate of outer diameter at center of shaft | 8/1000 | 15/1000 | 15/1000 | 12/1000 | 15/1000 | 15/1000 | 15/1000 | 15/1000 |
| EI value-variation-specified range from tip (percentage to whole length of shaft) | 30% | 40% | 50% | 50% | 45% | 55% | 50% | 50% |
| Maximum EI value (kg · $m^2$) in EI value-variation-specified range from tip | 3.00 | 5.00 | 2.50 | 3.00 | 2.50 | 2.50 | 2.50 | 2.50 |
| Position of center of gravity of shaft (from tip)(mm) | 501 | 504 | 502 | 503 | 503 | 503 | 503 | 503 |
| Variation of EI value (%) | 12 | 10 | 5 | 5 | 5 | 5 | 5 | 5 |
| Length of shaft (mm) | 880 | 880 | 895 | 895 | 895 | 895 | 895 | 883 |
| Number | 9 | 9 | 9 | 9 | 9 | 9 | 9 | 8 |
| Flight distance | X | X | ○ | ○ | ○ | ○ | ○ | ○ |
| Controlling performance | X | Δ | ◎ | ○ | ◎ | ◎ | ◎ | ◎ |

where "CE" denotes comparison example.
where "E" denotes example.

The shaft of the present invention was prepared by molding a material as will be described below. Two prepregs layered on each other were wound around a mandrel, with reinforcing fibers forming ±45° with respect to the longitudinal direction of the mandrel. Thereafter one prepreg forming an orientation of 0° with respect to the longitudinal direction of the mandrel was wound on the laminate of the two prepregs. Then two triangular prepregs forming 0° with respect to the longitudinal direction of the mandrel were wound thereon as a reinforcing layer for reinforcing the leading end (tip) of the shaft.

The number of turns of the reinforcing layers forming ±45° with respect to the longitudinal direction of the mandrel supplied to the butt side of higher-number irons were more than that supplied to the butt side of lower-number irons.

The mandrel having the same inclination rate in its diameter as that of the shaft in its diameter was used.

As the prepreg having a tensile modulus of elasticity of 30 tonf/mm$^2$, MR series (MR40) manufactured by Mitsubishi Rayon Kabushiki Kaisha and T800H, M30 manufactured by Toray Industries, Inc were used. As the prepreg having a tensile modulus of elasticity of 40 tonf/mm$^2$, HRX series (HR40) manufactured by Mitsubishi Rayon Kabushiki Kaisha and M40J manufactured by Toray Industries, Inc were used. As the prepreg having a tensile modulus of elasticity of 80 tonf/mm$^2$, YS-80 manufactured by Nippon Graphite was used.

EXAMPLES 1–6

The golf club shaft was prepared for a long iron. As shown in table 1, the EI value at the tip of the shaft and the diameter of the tip thereof and the like were set within the specified range of the present invention.

EXAMPLES 7–12

The golf club shaft was prepared for a middle iron. As shown in table 2, the EI value at the tip of the shaft and the diameter of the tip thereof and the like were set within the specified range of the present invention.

EXAMPLES 13–18

The golf club shaft was prepared for a short iron. As shown in table 3, the EI value at the tip of the shaft and the diameter of the tip thereof and the like were set within the specified range of the present invention.

COMPARISON EXAMPLES 1 and 2

The golf club shaft was prepared for a long iron. As shown in table 1, the EI value at the tip of the shaft and the diameter of the tip thereof and the like were set out of the specified range of the present invention.

COMPARISON EXAMPLES 3 and 4

The golf club shaft was prepared for a middle iron. As shown in table 2, the EI value at the tip of the shaft and the diameter of the tip thereof and the like were set out of the specified range of the present invention.

COMPARISON EXAMPLES 5 and 6

The golf club shaft was prepared for a short iron. As shown in table 3, the EI value at the tip of the shaft and the diameter of the tip thereof and the like were set out of the specified range of the present invention.

The iron golf club of each of the examples 1 through 18 and the comparison examples 1 through 6 was evaluated on the flight distance of a golf ball and the controlling performance by the method which will be described later. The results of evaluation are shown in the tables.

(Measurement of EI (Flexural Rigidity) Value)

Figure 4:
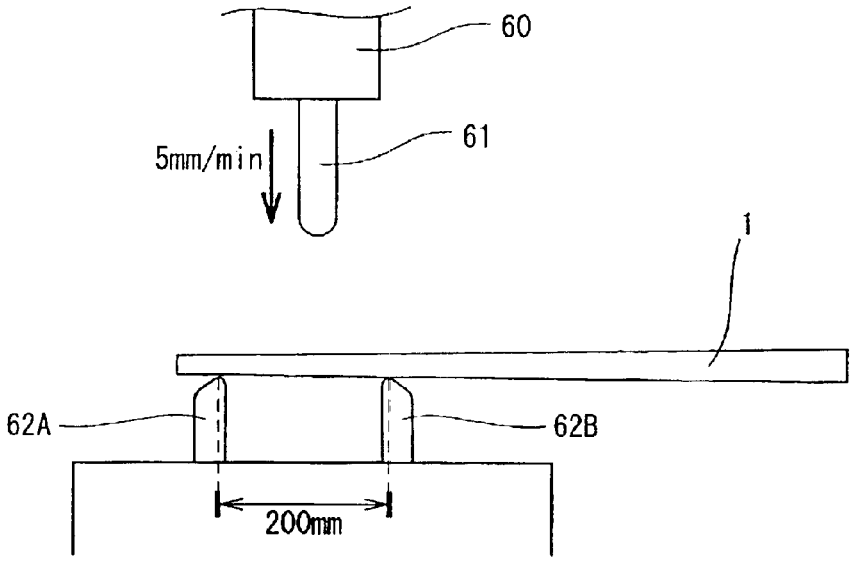
FIG. 4 shows a method of measuring the EI (flexural rigidity)

As shown in FIG. 4, by using a universal testing machine 60, measurement was conducted by flexing a shaft 1 by three-point bending.

After a measurement point was determined, the shaft 1 was disposed on jigs 62A and 62B in such a way that the measurement point was positioned under an indenter 61 of the universal testing machine 60. The interval between the jigs 62A and 62B was set to 200 mm. The radius of curvature of the indenter 61 at its lower end was set to 75R. The radius of curvature of each of the jigs 62A and 62B at the lower end thereof was set to 2R. The indenter 61 was moved downward at a test speed of 5 mm/min to flex the shaft 1. When a load to be applied to the shaft 1 reached 20 kgf, the movement of the indenter 61 finished to measure the flexure amount of the shaft 1 at that time.

$$EI(kg\cdot mm^2)(\text{load}\times(\text{distance between two supporting points})^3/(48\times\text{flexure amount})$$

Measured values were shown in the table by converting them into kg·mm$^2$.

(Method of Measuring GI (Twist Rigidity) Value)

From a calculation equation of the twist rigidity of a round rod, let it be supposed that a rigidity, a twist moment, a twist angle, and a specific twist angle were indicated by $GI_p$, Mt, $\phi$, and $\theta$ respectively. The equation representing the twist rigidity was derived:

$$I_p = \pi/32(d2^4 - d1^4)$$

$$\phi = 32Mt1/\pi Gd^4 \rightarrow \pi Gd^4 = 32Mt1/\phi$$

$$\theta = Mt/GI_p$$

$$= 32Mt/\pi Gd^4$$

Therefore $$GI_p = (\pi Gd^4/32Mt)Mt$$

$$= (32Mt1/32Mt\phi)Mt$$

$$= (1/\phi)Mt$$

$$GI = \text{Distance (mm) between two supporting points}\times\text{twist moment (kg}\cdot\text{mm)/twist angle (degree)}$$

Figure 5:
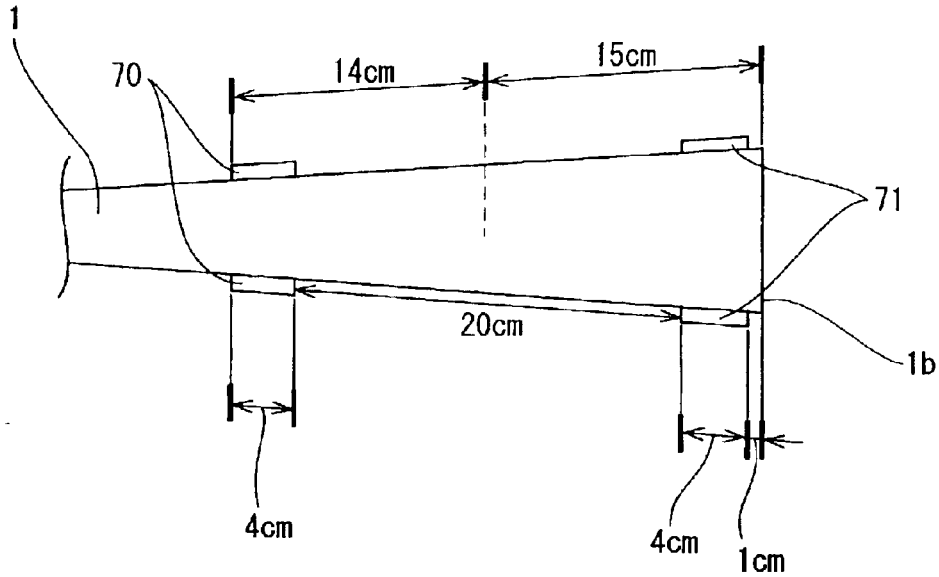
FIG. 5 shows a method of measuring the GI (twist rigidity).

More specifically, as shown in FIG. 5, a position spaced at 1 cm from a butt 1*b* of the shaft 1 and a position spaced at 29 cm from the butt 1*b* were chucked with chucks 70 and 71 of an air chucking method at a pressure of 1.5 kgf/cm$^2$. The length of contact between the shaft 1 and the chucks 70 as well as 71 was 4 cm. The distance between the inner side of the chuck 70 and that of the chuck 71 was 20 cm. A weight of 13.6 kgf was applied to the butt 1*b* of the shaft 1 to apply a torque of 13.9 kg·cm to the fixed large diameter portion of the shaft 1. The twist angle when the shaft 1 was twisted was measured to compute the twist rigidity.

(Evaluation of Flight Distance)

Fifty players having a head speed (H/S) of 40–45 m/s hit golf balls with the golf clubs. The case where 60% of 50 players hit golf balls not less than the specified distance, namely, 110 yards in the short iron, not less than the specified distance, namely, 150 yards in the middle iron, and not less than the specified distance, namely, 200 yards in the long iron was marked by ⊚. The case where not less than 40% nor more than 60% of 50 players hit golf balls more an the above-described distance was marked by ○. The case where less than 40% of 50 players hit golf balls more than the above-described distance was marked by x.

(Evaluation of Controlling Performance)

A test was conducted on ten golfers having handicap of 5–20. The golf club they felt best in the controlling performance was marked by ◎. The golf club they felt good in the controlling performance was marked by ○. The golf club they felt not good in the controlling performance was marked by Δ. The golf club they felt bad in the controlling performance was marked by x. The mark which the golf club got most was shown in the tables.

As the tables 1 through 3 indicate, the iron golf club shaft of each of the examples 1 through 18 was composed of the golf club shaft having the rigidity value at the tip of the shaft and the diameter of the tip thereof within the specified range of the present invention. Thus preferable evaluations were made on the flight distance of the golf ball and the controlling performance. It was confirmed that these iron golf club shafts allowed the players to hit golf balls long distances and had favorable controlling performance.

On the other hand, in the golf club of the comparison examples 1, 3, and 5, the range in which the EI value was almost constant was from the tip of the shaft to the position spaced therefrom at the distance corresponding to not less than 30% of the whole length of the shaft. That is, the range in which the EI value was almost constant was short. Thus the ball-hitting performance (flight distance)and the controlling performance were bad. In the golf club of the comparison examples 2, 4, and 6, the diameter of the tip of the shaft was as short as 8.5 mm. Therefore the ball-hitting performance and the controlling performance were bad.

As apparent from the foregoing description, according to the present invention, the EI (flexural rigidity) value is almost constant, that is, the EI value does not vary in the range from the tip of the shaft to the center in its longitudinal direction, namely, the position spaced from the tip at the distance corresponding to not less than 40% nor more than 60% of the whole length of the shaft. Further the diameter of the shaft at its tip is specified. Therefore the entire part of the shaft at its tip side is allowed to be flexible. In addition the shaft is allowed to be entirely flexible and capable of hitting a golf ball a long distance. Further the rigidity vale is almost constant at the tip side of the shaft, and the diameter of the tip of the shaft is specified. Thus the shaft is stable when it is swung and has a preferable controlling performance.

By composing the irons of the golf club shafts of the present invention and providing the iron golf club set consisting of the irons, a player can hit a golf ball a long distance and precisely control a flight distance and the like without discomfort being given to the player irrespective of the difference in the lengths of shafts of various numbers.

The invention being thus described, it will be obvious that the same may be varied in many ways. Such variations are not to be regarded as a departure from the spit and scope of the invention, and all such modifications as would be obvious to one skilled in the art are intended to be included within the scope of the following claims.

What is claimed is:

1. A golf club shaft made of a fiber-reinforced resin in which a difference between a maximum EI value and a minimum EI value in a range from a tip to a position spaced therefrom at a distance corresponding to not less than 40% nor more than 60% of a whole length of said shaft is set to less than 10% of an average of said maximum EI value and said minimum EI value in said range;

wherein a diameter of said tip of said shaft is set to not less than 9.0 mm nor more than 12.0 mm; and wherein a minimum EI value in a range from a butt to a position spaced therefrom at a distance corresponding to 30% of said whole length of said shaft is set to not less than 1.7 times nor more than 3.5 times larger than said maximum EI value in said range from said tip to said position spaced therefrom at said distance corresponding to not less than 40% nor more than 60% of said whole length of said shaft.

2. The golf club shaft according to claim 1, wherein said maximum EI value in said range from said tip to said position spaced therefrom at said distance corresponding to not less than 40% nor more than 60% of said whole length of said shaft is set to not less than 1.0 $kg \cdot m^2$ nor more than 3.0 $kg \cdot m^2$.

3. The golf club shaft according to claim 2, wherein an inclination rate of an outer diameter of said shaft in an intermediate portion between said range from a tip to a position spaced therefrom at a distance corresponding to not less than 40% nor more than 60% of said whole length of said shaft and said range from a butt to a position spaced therefrom at a distance corresponding to 30% of said whole length of said shaft is set to not less than $^{10}/_{1000}$ nor more than $^{20}/_{1000}$.

4. An iron golf club set consisting of a plurality of iron golf clubs having different numbers, wherein said iron golf clubs are composed of golf club shafts according to claim 2.

5. The iron golf club set according to claim 4, wherein the center of gravity of each of said golf club shafts is disposed closer toward a butt thereof and a twist rigidity (GI) value of each of said golf club shaft in a range of 15 cm from said butt thereof is set larger in said iron golf clubs having higher numbers than in said iron golf clubs having lower numbers.

6. The golf club shaft according to claim 2, wherein an inclination rate of an outer diameter of said shaft in an intermediate portion between said range from a tip to a position spaced therefrom at a distance corresponding to not less than 40% nor more than 60% of said whole length of said shaft and said range from a butt to a position spaced therefrom at a distance corresponding to 30% of said whole length of said shaft is set to not less than $^{10}/_{1000}$ nor more than $^{15}/_{1000}$.

7. The golf club shaft according to claim 1, wherein an inclination rate of an outer diameter of said shaft in an intermediate portion between said range from a tip to a position spaced therefrom at a distance corresponding to not less than 40% nor more than 60% of said whole length of said shaft and said range from a butt to a position spaced therefrom at a distance corresponding to 30% of said whole length of said shaft is set to not less than $^{10}/_{1000}$ nor more than $^{20}/_{1000}$.

8. An iron golf club set consisting of a plurality of iron golf clubs having different numbers, wherein said iron golf clubs are composed of golf club shafts according to claim 1.

9. The iron golf club set according to claim 8, wherein the center of gravity of each of said golf club shafts is disposed closer toward a butt thereof and a twist rigidity (GI) value of each of said golf club shaft in a range of 15 cm from said butt thereof is set larger in said iron golf clubs having higher numbers than in said iron golf clubs having lower numbers.

10. The golf club shaft according to claim 1, wherein the center of gravity of the shaft is situated in the range from the tip of the shaft to the position spaced therefrom at the distance corresponding to not less than 40% nor more than 60% of the whole length of the shaft.

11. The golf club shaft according to claim 1, wherein the golf club shaft is a short iron shaft.

12. The golf club shaft according to claim 1, wherein the golf club shaft is a long iron shaft.

13. The golf club shaft according to claim 1, wherein the golf club shaft is a middle iron shaft.

* * * * *